United States Patent [19]

Thiel

[11] 4,397,573

[45] Aug. 9, 1983

[54] DEVICE FOR EMBOSSING BRAILLE CODE CHARACTERS

[76] Inventor: Hans-Joachim Thiel, Pauerweg 4, 6104 Seeheim-Jugenheim 2, Fed. Rep. of Germany

[21] Appl. No.: 205,973

[22] Filed: Nov. 12, 1980

[30] Foreign Application Priority Data

Nov. 12, 1979 [DE] Fed. Rep. of Germany ..... 2945622

[51] Int. Cl.[3] ..... B41J 3/32

[52] U.S. Cl. ..... 400/122; 400/124; 101/93.32; 101/93.48; 101/18

[58] Field of Search ..... 400/118, 119, 122, 124; 101/93.3–93.34, 93.48, 18

[56] References Cited

U.S. PATENT DOCUMENTS

| | | | |
|---|---|---|---|
| 1,521,415 | 12/1924 | Atkinson et al. | 400/122 |
| 2,129,065 | 9/1938 | Loop | 400/124 |
| 2,694,362 | 11/1954 | Paige | 400/124 |
| 2,766,686 | 10/1956 | Fomenko et al. | 101/93.31 |
| 2,916,920 | 12/1959 | Planer et al. | 101/93.31 |
| 3,139,820 | 7/1964 | Kittler | 101/93.31 |
| 3,292,531 | 12/1966 | Mutz | 101/93.30 |
| 3,473,466 | 10/1969 | Thayer | 101/93.34 |
| 3,630,142 | 12/1971 | Fulks et al. | 101/93.33 |
| 3,715,020 | 2/1973 | Nordin | 400/124 |
| 3,823,804 | 7/1974 | Lokey | 400/122 |
| 3,876,052 | 4/1975 | Carbonneau | 400/122 |
| 3,880,269 | 4/1975 | Carbonneau | 400/122 |
| 4,174,182 | 11/1979 | Lendl | 400/124 |
| 4,183,683 | 1/1980 | Hiratsuka | 400/122 |
| 4,261,663 | 4/1981 | Grimnes | 400/122 |

FOREIGN PATENT DOCUMENTS

| | | | |
|---|---|---|---|
| 2753923 | 6/1979 | Fed. Rep. of Germany | 400/122 |
| 7802332 | 9/1979 | Netherlands | 400/122 |
| 936354 | 9/1963 | United Kingdom | 101/93.31 |

OTHER PUBLICATIONS

Proebster, "Highspeed . . . actuator", IBM Technical Disclosure Bulletin , vol. 14, No. 7, p. 2238, 12/71.

Eller et al., "Electromechanical Transducer", IBM Technical Disclosure Bulletin, vol. 12, No. 12, pp. 2207–2208, 5/70.

McCarty, "Print Hammer Unit", IBM Technical Disclosure Bulletin, vol. 15, No. 3, pp. 824–825, 8/72.

*Primary Examiner*—William Pieprz

*Attorney, Agent, or Firm*—Michael J. Striker

[57] ABSTRACT

The device for embossing Braille code characters on a movable paper web includes a set of plungers supported for reciprocating movement against a stationary matrix for embossing dots in respective lines; a continuously reciprocating beam is arranged below the lower ends of all plungers and each plunger cooperates with an actuation device such as a solenoid which selectively deviates the lower end of the plunger out of engagement or into engagement with the impact surface of the reciprocating beam.

17 Claims, 11 Drawing Figures

DEVICE FOR EMBOSSING BRAILLE CODE CHARACTERS

BACKGROUND OF THE INVENTION

The present invention relates in general to embossing Braille characters, and in particular to a device for printing or typing such characters, the device being of the type having an embossing matrix provided with holes arranged according to Braille coded lines, means for moving a web to be embossed along the matrix at right angles to the lines, a series of stamping plungers for striking against the holes, means for selectively controlling the stamping plungers in response to coded signals in order to emboss selected dots in the web.

In a known device of this kind described for example in U.S. Pat. No. 3,880,269, each individual stamping plunger is controlled by an assigned solenoid which imparts to the plunger its stamping movement. The actuation of a respective stamping plunger is therefore immediately effected by the assigned solenoid. As a consequence, energy required for the control signal is relatively large, because the signal is also employed for energizing the stamping process.

In the known device the return movement of activated stamping members is accomplished by means of springs and the force of these springs must also be overcome by the solenoid. Accordingly, because of the increased magnitude of the transmitted forces, the overall construction of this known device is relatively heavy. The mass to be moved at each stroke of the stamping plunger is very large, and consequently the working speed of the device is comparatively low.

SUMMARY OF THE INVENTION

It is therefore a general object of the present invention to overcome the aforementioned disadvantages.

More particularly, it is an object of the invention to provide an improved Braille embossing device of the aforedescribed type which requires a substantially reduced energy for activating the individual actuation elements for performing the embossing process.

An additional object of the invention is to provide such an improved device which has a substantially reduced weight.

A further object of the invention is to provide an improved Braille embossing device which can operate at a high working speed.

In keeping with these objects, and others which will become apparent hereafter, one feature of the invention resides in assigning to respective stamping plungers an actuation member the controlling movement of which is effected substantially at right angles to the striking direction of the plungers, whereby the actuation members displace the rear ends of selected stamping plungers into and from engagement with a continuously oscillating beam which swings with an amplitude corresponding to the strokes of the stamping plungers.

The force necessary for executing the stamping process is hereby executed exclusively by the driven oscillating beam; the actuation members serve therefore for controlling the displacement of the rear ends of respective stamping plungers only in order to engage or disengage the same from the swinging beam. Due to the fact that the direction of movement of the actuation members is substantially at right angles to the striking direction of the stamping plungers, the actuation members are completely separated from the influence of forces developed for the embossing or stamping process. Control signals applied to the actuation members require therefore a very low energy only. Forces exerted by the actuation members on the stamping plungers are very small and consequently component parts employed for the transmission of such forces can be of a very light structure. As a result, due to the low mass of the moving component parts, the working speed of the device can be considerably increased. The power transmission for the embossing process takes place immediately from the driving oscillatory beam in the longitudinal direction of respective stamping plungers.

From the aforementioned prior-art device for embossing Braille characters according to U.S. Pat. No. 3,876,052, actuation members are known which move transversely to the striking direction of stamping members in order to control the embossing process. These known actuation members, however, are assigned to individual embossing matrixes provided, respectively, with holes or recesses for fixed dots of the Braille code to move these matrixes transversely to the striking direction of the stamping plungers. A set of stamping plungers assigned to a line of Braille characters are arranged on six common carriers. During the embossing process, the plunger carriers are moved so that all stamping plungers pertaining to a complete line are activated according to a pattern pertaining to a particulr Braille code character; nevertheless, only one embossing matrix is brought into engagement with the stamping plungers at those locations of the sheet to be embossed where the code character is to appear.

In the known device, as mentioned before, the force which is necessary for the embossing process is exerted by the same actuation members which control the six plunger carriers. Moreover, in the prior-art device there is not embossed during each embossing step or process a complete line of dots, but there is embossed only a single Braille character. Accordingly, for printing one line of such characters, there are necessary so many embossing steps or processes as there are lines present in each code character.

In a further elaboration of the device of this invention, there are provided guiding means for respective stamping plungers in which the latter are tilted by means of the actuation members in such a manner that the rear ends of respective plungers which are remote from the embossing matrix are brought into engagement and alternatively out of engagement with an abutment surface of the oscillating beam.

By virtue of the swinging movement of the stamping plungers, a very small force is required for controlling the angular position of the plungers.

It has been proven as particularly advantageous when each stamping plunger is provided with a stop cooperating with a retaining element formed on the oscillating beam. In this manner it is achieved that, during backstroke of the oscillating beam, all stamping plungers are positively engaged by the beam and simultaneously retracted. As a result, there is no danger of failure of prior-art return springs which, for one reason or another, might exert insufficient force for returning the actuated plungers. In addition, it is no longer necessary during the forward stroke of the plungers to counteract the force of return springs which, in the case of a large number of stamping plungers, can add up to a very high value.

It is also of advantage when the retaining member for the stop elements of stamping plungers is in the form of a comb for guiding respective stamping plungers in the gaps between its prongs, whereby the end portion of each plunger between the retaining comb and the abutment surface of the oscillating beam is provided with a stop in the form of a flange. By means of this very simple structure it is achieved that respective stamping plungers can perform a swinging movement relative to the oscillating beam without any obstruction by the retaining member.

According to still another feature of this invention, each stamping plunger is provided with an additional stepped shoulder or flange, preferably at the front end portion thereof, which during return movement of the plunger engages an abutment member connected to the guiding plate for the plungers, the abutment member being preferably in the form of a comb plate arranged under the guide plate. In this way, the stamping plungers are suspended for free swinging movement, and no additional structural measures are necessary for guiding the plungers in their longitudinal direction when the latter are disengaged at the rear ends from the oscillating beam. The comb-like configuration of both abutment members enables a very simple assembly of the stamping plungers. The actuation members are preferably solenoids oriented transversely to the striking direction of the stamping plungers. The striking members of respective solenoids are coupled to assigned stamping plungers by means of a splice strap. The coupling splice straps permit deviation perpendicularly to the direction of movement of the solenoids without the necessity of providing movable guides on respective stamping plungers, and without transmitting any reaction forces to the solenoids from the driving beam.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

Figures 1, 2, 3:
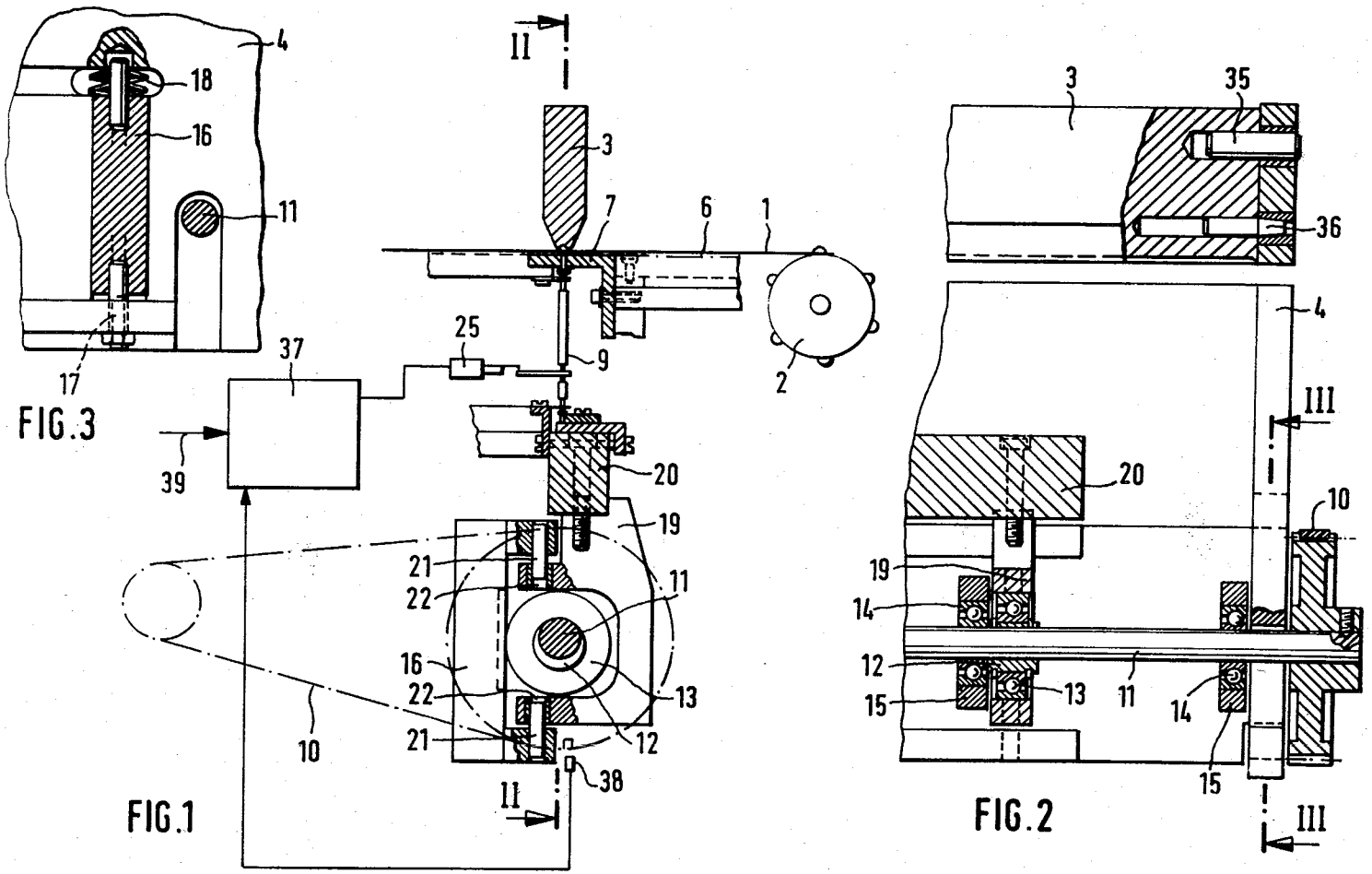
FIG. 1 is a sectional side view showing essential component parts of the device for embossing Braille according to this invention.
FIG. 2 is a sectional view of a part of the device of FIG. 1 taken along the line II—II.
FIG. 3 is a sectional view of a cut-away part of FIG. 2 taken along the line III—III.
Figures 4, 5:
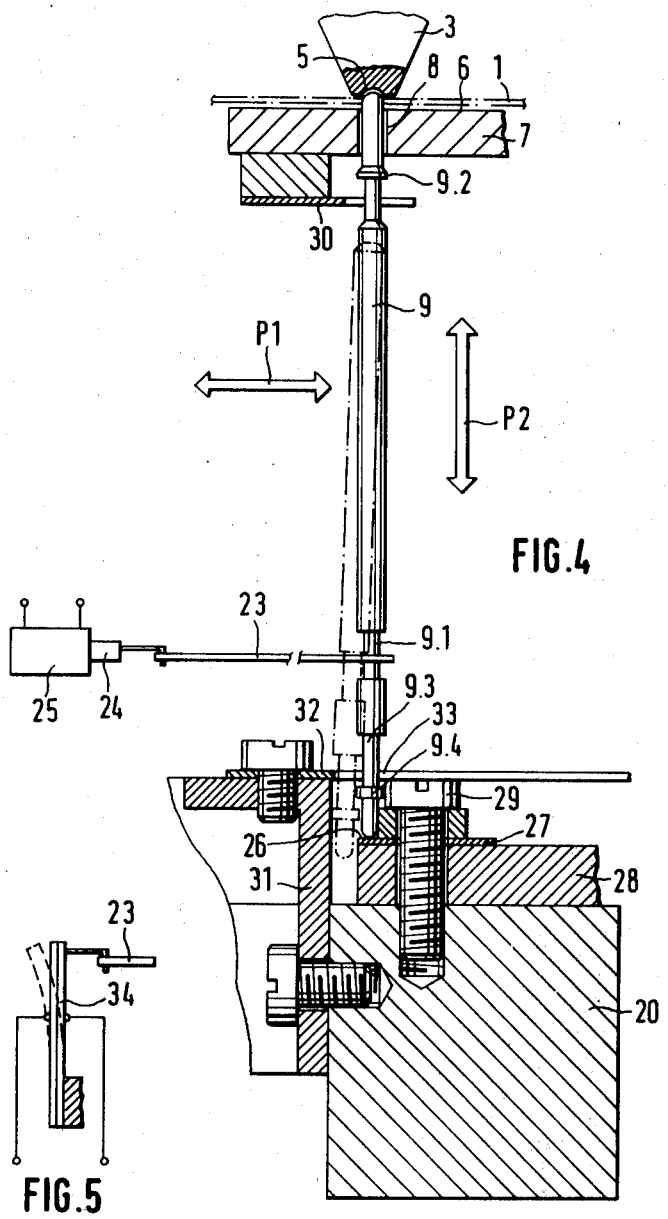
FIG. 4 is a view similar to FIG. 1 showing on an enlarged scale the arrangement and actuation of stamping plungers.
FIG. 5 is a modified version of the embodiment of FIG. 4.
Figure 7:
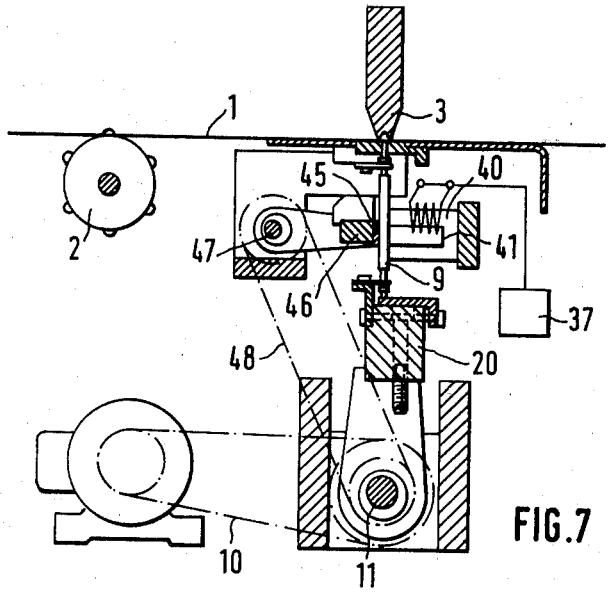
Figure 11:
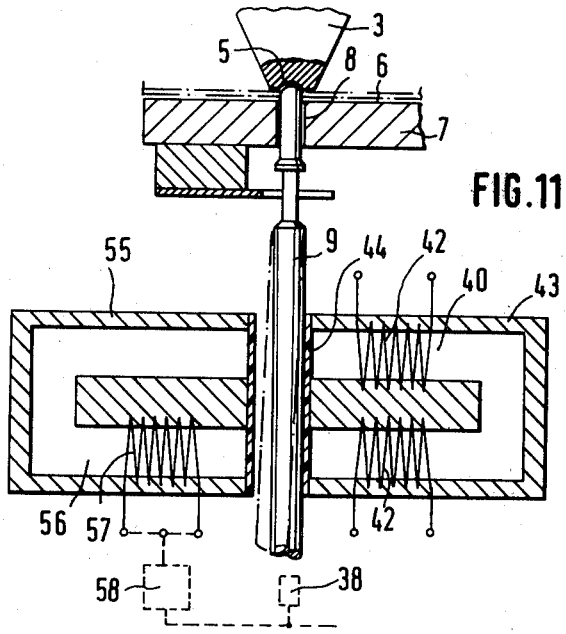
Figure 8:
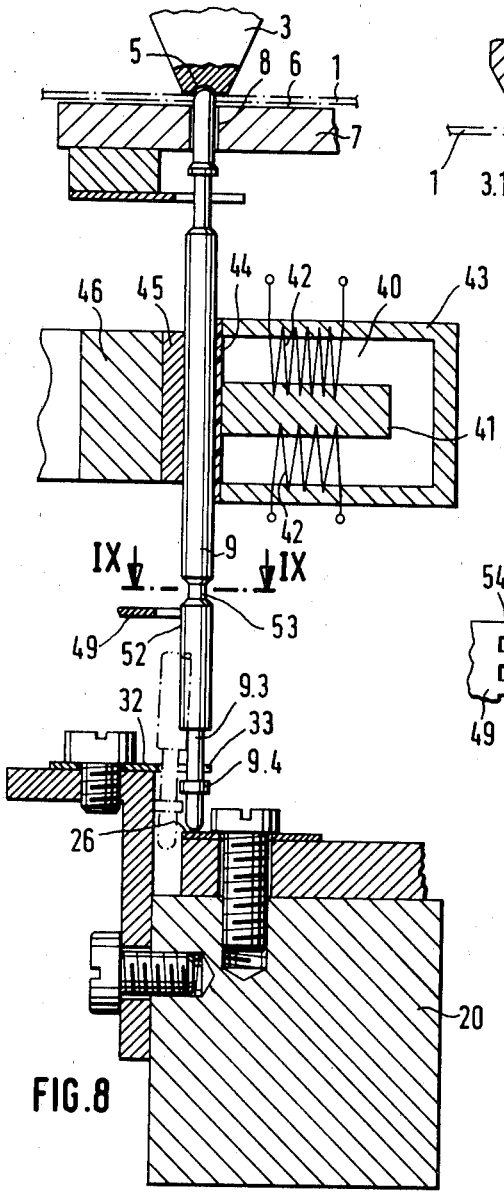
Figure 10:
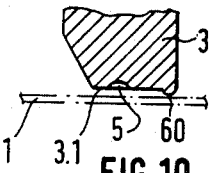
Figure 9:
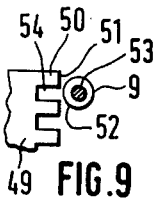

Further embodiments of the invention are shown in the Figures described as follows. Shown in:

FIG. 7, in a section similar to FIG. 1, an embodiment wherein the actuation members for the stamping plungers are solenoids arranged at both sides of the row of stamping plungers, FIG. 8, the embodiment as per FIG. 7, in an enlarged representation similar to FIG. 4, FIG. 9, a partial section along line IX—IX in FIG. 8, FIG. 10, in a partial section, a modified embodiment of the embossing matrix, and FIG. 11, a further modified embodiment in a partial section similar to FIG. 8.

DESCRIPTION OF THE PREFERRED EMBODIMENTS

Referring firstly to FIG. 1, a web 1 of a strong paper or a thin carboard is moved by means of a feeding mechanism of which only a sprocket roller 2 is shown, past an embossing matrix 3. The matrix is fixedly mounted on a frame 4 and on its lower side facing the web 1 is formed with a plurality of holes or recesses 5 (FIG. 4). Web 1 is guided on a guiding surface 6, of which only a part is illustrated in FIG. 1. The guiding surface 6 includes a guiding plate 7 located under the recesses 5 and being formed with guiding bores 8 for stamping plungers; the guiding bores register with respective recesses 5. As illustrated in greater detail in FIG. 4, each guiding hole or bore 8 guides the upper end portion of a stamping plunger 9. The end face of the plunger has a semispherical configuration matching the form of the assigned recess 5. When the stamping plunger 9 is moved upwardly, the curved surfaces of the plungers 5 and of the corresponding recesses 5 emboss a dot in the web 1 and these dots, as known, are arranged according to respective Braille code characters.

A belt drive 10 schematically illustrated in FIG. 1 drives a shaft 11 which is supported for rotation in roller bearings 14 mounted in arm 15 of a supporting bracket 16 which is adjustably mounted in the stationary frame 4. The vertical adjustment of the bracket 16 is effected by a setting screw 17 (FIG. 3) which acts against the force of a pack of cup-shaped springs 18 provided between the frame 4 of the apparatus and the bracket 16.

The driven shaft 11 supports a plurality of consecutively arranged eccentrics 12 and each eccentric supports a roller bearing 13. The roller bearings 13 engage respectively a C-shaped recess of a bracket 19 which is connected to a common embossing beam 20. In addition, by means of two vertically directed guiding pins 21 projecting inwardly from the arm 15 of the adjustable bracket 16, to engage matching recesses 22 in the arm of the beam bracket 19, the latter is movable in vertical direction with respect to the adjustable bracket 16.

By rotating the shaft 11, the beam bracket 19 and thus the beam 20 are driven to perform an up-and-down oscillatory movement.

Figure 6:
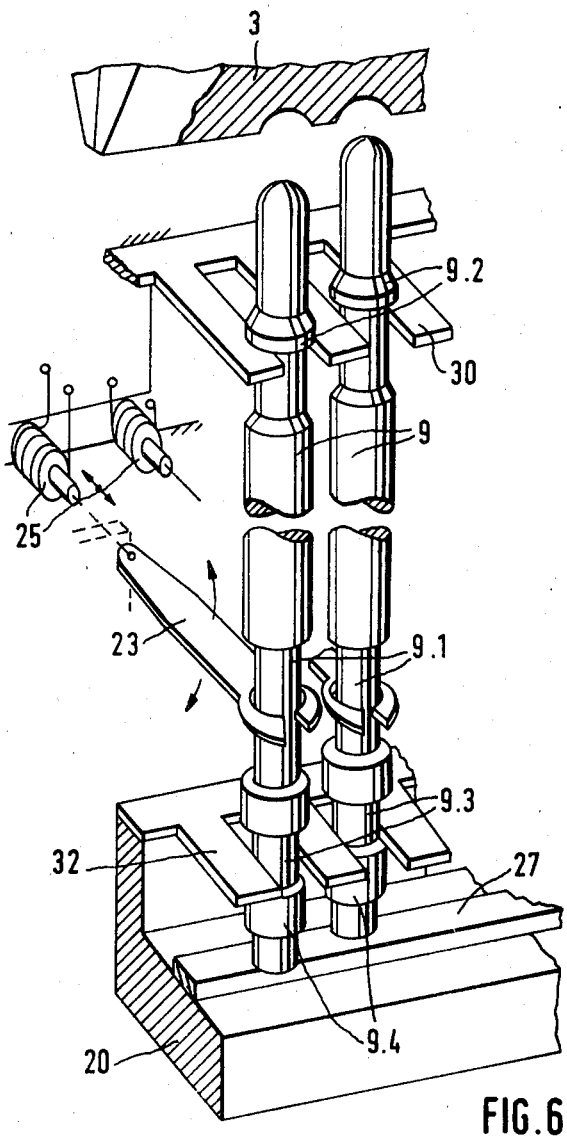
FIG. 6 is a simplified perspective view of component parts of FIG. 4.

As depicted in FIG. 4, the upper end portions of respective stamping plungers 9 are guided in the bores 8 of the guiding plate 7 with sufficient play to permit a lateral swing of the plungers in the direction indicated by arrow P1. The lower end portion of each plunger has a section 9.1 of reduced diameter, and this section is loosely clamped by a split eye of an actuating strap 23 which in turn is connected to armature 24 of a solenoid 25 (FIG. 6).

Full lines in FIG. 4 indicate an activated position of the plunger 9 in which its lower end face is in abutment with the impact surface 26 of the oscillating beam 20. The impact surface 26 is formed by a hardened steel strap 27 arranged on top of an abutment rail 28 and fastened to the beam 20 by a screw 29.

When solenoid 25 is energized to exert pulling force in horizontal direction as indicated arrow P1, the stamping plunger 9 is deflected laterally into its inactivated position indicated by dash-and-dot lines in FIG. 4. In this inactivated position its lower end face is disengaged from the impact surface 26 of the oscillating beam. As soon as the lower end of the plunger 9 is returned into its activated position in engagement with the impact surface 26, it is lifted by the stroke of the beam 20 and completes in cooperation with the recesses 5 the embossing process in the web 1. In its inactivated position, plunger 9 is laterally swung out of the range of movement of the impact surface 26 and remains therefore unaffected by the oscillatory movement of the beam 20 and no embossing takes place. In this manner, the solenoids 25 pertaining to respective plungers 9 can be selectively controlled during the continuous movement of the beam 20 to activate or inactivate the assigned embossing plungers.

In order to limit the fall of the plunger 9 when the latter is swung out into its inactivated position off the impact surface 26, the upper part of the plunger is provided with a flange 9.2 above a comb-like plate 30 which is secured to the lower surface of the guiding plate 7. The comb-like plate 30 thus forms a stop surface for the flange 9.2.

Another comb-like plate 32 is secured by means of an angle rail 31 to the oscillating beam 20 and extends parallel with the impact strap 27. The slots or gaps between the prongs of the comb-like plate 32 guide sections 9.3 of reduced diameter formed on the lower part of each plunger. The slots 33 between the prongs of the retaining comb 32 are oriented transversely to the direction of oscillating movement of the beam 20. Below the retaining comb 32, each stamping plunger 9 is provided with an additional flange 9.4 which, during the downward movement of the oscillating beam 20, engages the lower surface of the retaining comb 32 so that the plunger is positively driven in the direction of arrow P2 downwardly.

Referring now to FIG. 5, the actuation members for inducing the lateral swinging movement of respective stamping plungers 9 are in the form of piezoelectric laminated bending elements 34 instead of solenoids 25. Upon application of an electrical voltage on the laminae of the elements 34, the latter bend to a position indicated by dash lines in FIG. 5. The piezoelectric bending elements are coupled to the assigned plunger by the aforedescribed coupling strap 23, or can be immediately connected to the oscillating beam assembly parallel to the plungers. In the latter case, a particularly compact structure of the device will result.

The embossing matrix 3, as seen from FIG. 2, is pivotably mounted on pivot pins 35 projecting from the frame 4. A conical arresting bolt 36 on each side of the frame 4 arrests the matrix 3 in its operative position. Upon screwing respective arresting bolts into the threaded hole in the matrix 3, the latter can be moved upwardly, for example for inspection or for cleansing the embossing recesses.

The energization of solenoids 25 is carried out by means of a control device 37 schematically indicated in FIG. 1. After each revolution of the shaft 11, the control device 37 receives a signal from a photoelectric cell 38 and in addition control signals are applied to the control input 39. The control signals are coded in accordance with the Braille code characters to be embossed on the web 1 and are synchronized by the signal from the cell 38 so that during each rotation of the shaft, predetermined plungers 9 are activated or inactivated. As it has been explained before, the series of plungers 9 in response to the applied control signals are either engaged with or disengaged from the impact surface on the oscillating beam 20 to emboss the desired Braille character. By virtue of the fact that stamping plungers 9 are guided in the bores 8 and on the upper comb plate 30 in such a manner that they are freely swingable in the direction of arrow P1, the force exerted by the actuation members 25 or 34 for inducing the lateral swinging movements of the plungers is very small. Moreover, play or tolerance of the upper part of plungers 9 in the guiding bores 8 is designed to be sufficiently large as to permit paper dust produced during the embossing process to pass through and, at the same time, to permit the self-centering of the rounded tips of the plungers 9 in the corresponding recesses of the matrix 3.

The lateral swinging movement of the plungers 9 in the direction of arrow P1 is possible only when the oscillating beam 20 with its impact surface 26 is at least approximately in its lowermost position. The signal generated by the photoelectric cell 38 synchronize the energization of the actuation members 25 with the occurrence of this lowermost position of the beam 20.

The stepped down section 9.1 of the stamping plunger coupled to the fork-shaped or split eye of the actuation strap 23 acts simultaneously as a rated breaking point for the case when the plunger is accidentally subject to an excessive bending load. In this manner it is ensured that no major damage can occur in the device when overloaded, inasmuch as the suspended mounting of the plungers 9 permits a very easy exchange.

The embodiment shown in FIGS. 7 and 8, wherein identical parts are denoted by references identical to those used in the preceding Figures, differs from the embodiment as per FIGS. 1–6 in essence by the provision, at each side of the row of stamping plungers 9, of a row of solenoids 40 each of which being assigned to a respective individual stamping plunger 9. Each solenoid 40 is provided with a respective U-shaped core 41, with the ends of both legs of the latter facing the stamping plunger 9. One or both of the respective core legs support a solenoid winding 42. The stamping plungers 9 are, herein, constituting the electromagnetic armature of the solenoids. All solenoids 40 are joined by casting into a common solenoid bar 43 (FIG. 8). The surface of solenoids 40 facing the stamping plunger 9 is provided with a friction-reducing plastic layer 44, consisting, for instance, of PTFE.

At the opposite side of the row of stamping plungers 9, there is provided a permanent-magnet bar 45, mounted upon a bracket 46. The bracket 46 is linked to an eccentric 47 supported in the machine frame and being in driving connection over a slip-free belt drive 48 with the eccentric shaft 11 serving for the oscillating motion of embossing beam 20. By means of this transmission link, permanent-magnet bar 45 is moved back and forth transversal to the direction of the stamping plungers 9 and synchronous with the oscillating motion of embossing beam 20.

Energizing of solenoids 41 is controlled by the control circuit 37 in such a manner that at the beginning of each oscillating motion of embossing beam 20, only those solenoids 40 for stamping plungers 9 are activated where the respective plungers are to execute a stamping process. The magnetic force exerted by the solenoids 40 upon the stamping plungers 9 is greater than the magnetic holding force of permanent-magnet bar 45, said bar, at the begin of the oscillating motion of embossing beam 20 having in a lateral direction away from the stamping plungers 9. Thus, those stamping plungers 9 that have their solenoid 40 energized at that moment, will be held at the solenoid 40 and will come into engagement with the impact surface 26 of embossing beam 20. The other stamping plungers 9, with their respectively assigned solenoids 40 not energized, will follow herein the permanent-magnet bar 45 and are swung into the position indicated in FIG. 8 by the dot-dash lines, so that there is no engagement with the impact surface 26.

The stamping plungers 9 held, in the respective instance, by solenoids 40 will, during the embossing motion, slide along the plastic layer 44. In order to further reduce the friction occurring therein, the control device 37 may be designed in such a manner that shortly after commencement of the oscillating motion of embossing beam 20, also those solenoids 40 initially energized and holding their respectively assigned stamping plunger 9, will be de-energized. In order to prevent the stamping plungers 9, not held any longer by the solenoids 40, from also following at that moment the magnetic force of permanent-magnet bar 45, provision is made for a stationary comb beam 49, (FIG. 9), the comb prongs 50 of which form guide surfaces 51 at which a cylindrical external-surface section 52 of the responsive raised stamping plunger 9 will abut. The already raised stamping plungers 9 are guided thereby in the vertical direction, and these stamping plungers are prevented thereby, from swinging outward as soon as the solenoids 40 are de-energized.

However, to allow a swinging motion of those stamping plungers 9 that are to be brought out of engagement with impact surface 26, the stamping plungers 9 are provided with a throat 53 above the cylindrical external-surface section 52, said throat matching a respective interstice 54 between the comb prongs 50. When in their lower position, the stamping plungers 9 may therefore be laterally swung out by the permanent-magnet bar 45, with the throat 53 entering herein a respective prong interstice 54.

Instead of the mechanically actuated permanent-magnet bar 45, provision may be made for a stationary solenoid bar 55 (FIG. 11), arranged at a distance from the stamping plunger 9, and consisting of one or a plurality of solenoids 56 with their solenoid coil 57 being energized by a control circuit 58 indicated by dot-dash lines in FIG. 11, energizing ensuing in dependence upon a signal generated by the photovoltaic cell 38 or another transmitter and in such a manner that the stamping plungers 9 are swung laterally unless arrested by the respective assigned solenoid 40. While in the embodiment as per FIGS. 7 and 8, the return of the stamping plungers 9 into the initial position is effected by the return movement of the permanent-magnet bar 45 into the initial position shown in FIGS. 7 and 8, such return is effected in the embodiment as per FIG. 11 by de-energizing the solenoid(s) 56 and energizing all solenoids 40.

FIG. 10 shows a modified embodiment of embossing matrix 3. Provision is made therein, along one longitudinal edge of embossing matrix 3, for a ledge-shaped projection 60 extending outward from the face side 3.1 of embossing matrix 3 and arranged at a distance to the row of recesses 5. This projection 60 will cause the paper or cardboard web 1 to be drawn out of the recesses 5 by the pulling action of the sprocket roller 2. It is prevented thereby that parts of the paper or cardboard web 1, that have been pressed into the recesses 5 during feeding of the paper or cardboard web 1, would remain in the recesses 5. The force required for feeding the paper or cardboard web may be considerably reduced by this measure; damages are, furthermore, prevented.

It will be understood that each of the elements described above, or two or more together, may also find a useful application in other types of constructions differing from the types described above.

While the invention has been illustrated and described as embodied in a device for printing Braille characters, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for embossing Braille code characters comprising an embossing matrix provided with recesses arranged according to Braille code dot lines, means for moving a web to be embossed past the recesses of said matrix, a set of stamping plungers arranged for a vertical reciprocating movement opposite said recesses in the matrix, means for guiding top ends of respective plungers into the recesses, a beam supported for a continuous reciprocating movement at the lower ends of said plungers, a plurality of actuating members coupled to respective plungers for selectively moving the same out of engagement or into engagement with the continuously reciprocating beam, said reciprocating beam supporting an impact surface cooperating with the lower ends of said plungers, said actuation members being coupled to the lower portions of said plungers for swinging the same in a transverse direction relative to the direction of the vertical reciprocating movement, whereby the lower ends of said plungers are selectively brought into and out of engagement with said impact surface, said beam being provided with guiding and retaining means for said plungers, and lower end portions of said plungers being formed with stepped members engageable with said guiding and retaining means during a return stroke of said beam.

2. A device as defined in claim 1, wherein said plungers are of a magnetizable material and said actuation means includes a reciprocating magnetic member arranged at one side of the stamping plungers for imparting a lateral swing to said stamping plungers in synchronism with the reciprocating movement of the beam, and further including a row of solenoids arranged at the opposite side of said plungers, said solenoids being selectively energizable to neutralize the effect of said magnetic member on selected plungers.

3. A device as defined in claim 2, wherein said magnetic member is a permanent-magnet bar extending transversely relative to said plungers, and further including a reciprocating drive coupled by transmission to said bar and to said beam.

4. A devide as defined in claim 2, further comprising a stationary guide area for said plungers; control means actuatable by the impact beam motion for controlling energization of said solenoids; each stamping plunger being engageable with the stationary guide area only when in raised state, and all solenoids being jointly deenergizable synchronously with the reciprocating movement of the beam.

5. A device as defined in claim 4, wherein each stamping plunger is formed with a recessed surface portion, and said stationary guide area including comb prongs with interstices matching said recessed surface portion.

6. A device as defined in claim 2, each solenoid having a U-shaped core the end surfaces of the legs of which face the stamping plunger.

7. A device as defined in claim 6, wherein the surface of solenoids facing the stamping plungers is provided with a friction-reducing plastic layer.

8. A device as defined in claim 2, wherein the magnetic members includes at least one stationary solenoid energizable synchronously with the oscillatory motions of the impact beam.

9. A device as defined in claim 1, wherein the embossing matrix is provided with a projection extending against the web to be embossed.

10. A device as defined in claim 1, wherein said guiding and retaining means have the form of a comb-like plate secured to said beam and extending above said impact surfaces, said plungers being guided between the prongs of said comb-like plate in said transverse direction and said stepped members on the lower parts of said plungers being located below said comb-like plate.

11. A device as defined in claim 1, wherein the upper part of each plunger below said guiding means is formed with an additional stepped member cooperating with the guiding and retaining means to limit the downward movement of said plungers.

12. A device as defined in claim 11, wherein said guiding and retaining means includes comb-like plate guidingly engageable a portion of said plungers below said additional stepped member to guide the same in said transverse direction.

13. A device as defined in claim 1, wherein said actuation members include solenoids and means for linking the armature of respective solenoids to the assigned plungers for moving the same in a transverse direction relative to the direction of movement of said beam.

14. A device as defined in claim 1, wherein said actuation members include piezoelectric bending elements linked to respective stamping plungers.

15. A device as defined in claim 14, wherein said piezoelectric bending elements are mounted on said beam parallel to the assigned plungers and are coupled to the latter.

16. A device as defined in claim 1, further including a stationary frame for supporting said matrix, a vertically adjustable bracket mounted on said frame and supporting for rotation a driving shaft provided with eccentric means for driving said reciprocating beam.

17. A device as defined in claim 16, wherein said stationary bracket includes guiding means for guiding said beam in the directions of its reciprocating movement.

* * * * *